US005727700A

United States Patent [19]

Digney

[11] Patent Number: 5,727,700

[45] Date of Patent: Mar. 17, 1998

[54] OVERHEAD DISPLAY UNIT FOR INFLATED BALLOONS

[75] Inventor: John J. Digney, Cleveland, Ohio

[73] Assignee: American Greetings Corporation, Cleveland, Ohio

[21] Appl. No.: 395,787

[22] Filed: Feb. 28, 1995

[51] Int. Cl.[6] ..... A47F 5/08

[52] U.S. Cl. ..... 211/119; 211/181

[58] Field of Search ..... 211/13, 106, 119, 211/181, 189; 446/220, 221

[56] References Cited

U.S. PATENT DOCUMENTS

| | | | |
|---|---|---|---|
| 360,114 | 3/1887 | Schoonmaker | 211/119 |
| 391,675 | 3/1888 | Bernardi | 211/119 |
| 1,024,369 | 4/1912 | Sechrist | 362/404 |
| 3,225,720 | 12/1965 | Maslow | 211/181 X |
| 3,315,819 | 4/1967 | Kingsbery | 211/13 X |
| 3,905,286 | 9/1975 | Le Grady | 211/181 X |
| 4,247,144 | 1/1981 | Radek | 211/181 X |
| 4,345,688 | 8/1982 | De Boer | 211/106 X |
| 4,561,547 | 12/1985 | Estwanik | 211/14 |
| 4,765,495 | 8/1988 | Bisk | 211/119 X |
| 4,888,836 | 12/1989 | Calderwood | 446/220 X |
| 4,953,713 | 9/1990 | Yaffe | 211/13 |
| 5,031,908 | 7/1991 | Spector | 446/220 X |
| 5,199,572 | 4/1993 | Abe | 446/220 X |
| 5,213,221 | 5/1993 | Raye, Sr. | 211/181 X |
| 5,405,026 | 4/1995 | Lee et al. | 211/106 X |
| 5,437,380 | 8/1995 | Peay et al. | 211/181 X |
| 5,460,280 | 10/1995 | Feddeler | 211/119 X |
| 5,564,575 | 10/1996 | Casement | 446/220 X |

*Primary Examiner*—Leslie A. Braun
*Assistant Examiner*—Richard M. Smith
*Attorney, Agent, or Firm*—Oldham & Oldham Co., L.P.A.

[57] ABSTRACT

A device for displaying inflated balloons, particularly pillow-shaped MYLAR-type balloons has a closed perimeter formed from at least one downwardly-open channel member. The downwardly-open channel member has a width slightly larger than the thickness of the balloons displayed therein, so the balloons are restrained in a position to allow display of one of the generally planar surfaces of the balloon through the outwardly facing surface of the channel member. A top retaining member, comprised of either a ceiling to which the perimeter is attached or a grid-like member attached to the perimeter and suspended from the ceiling, acts with the perimeter to form a downwardly-open cavity in which additional inflated balloons may be stored for sale.

3 Claims, 4 Drawing Sheets

OVERHEAD DISPLAY UNIT FOR INFLATED BALLOONS

The present invention relates to an overhead display unit, particularly a unit for displaying balloons. More particularly, the present invention relates to an overhead display unit for displaying balloons manufactured from two sheets of thin polymer film, placed in registration and sealed along the edge, which have a characteristic thickness which is less than the characteristic width or height of the balloon. Even more particularly, the present invention is an overhead display unit for displaying such balloons so that one of the two generally planar decorated surfaces of the balloon is fully exhibited to the potential purchaser.

BACKGROUND OF THE ART

A MYLAR-type balloon is generally constructed by overlaying two sheets of a thin polymeric material, typically a polyester that is characteristically metallized and which is sold by E.I. du Pont de Nemours & Company of Wilmington, DE, under their registered trademark MYLAR. The peripheral edge of the sheets are sealed to each other, typically by thermal means, leaving a single entry port through which inflation gas may be introduced. When the inflation gas is lighter than air, such as helium, the MYLAR-type balloon presents a generally pillow-shape form, which presents a front and rear surface, upon which decorative indicia may be imprinted. Obviously, a balloon, particularly of the type formed of latex, which has a generally spherical or cylindrical shape when inflated does not have the pillow-shape form. Instead, the inherent symmetry of the latex-type balloon makes it difficult to identify a "front" or a "rear" surface. Although such balloons may be displayed in the present invention display unit, such display may not be as effective as the display of the MYLAR-type balloon, due to the shape of the latex balloon. For that reason, in this patent specification, reference to a "balloon" will generally mean a balloon of the MYLAR-type, unless otherwise specified.

When selling the MYLAR-type balloons in an inflated state, sales are enhanced by a display format wherein at least one of the generally planar decorative front or rear surfaces of the balloon is prominently displayed.

Overhead display units of the prior art have generally randomly agglomerated the inflated MYLAR-type balloons in a net or corral, which does not effectively exhibit the decorated planar surface or surfaces. Display units that have fully exposed or displayed the decorated planar surface have typically been used only with the uninflated balloon. Each of these display modes has an obvious disadvantage. The inflated balloon in an overhead net is ready for an impulse buy, but only if the potential purchaser is lucky enough to espy its attractive decoration. On the other hand, the uninflated balloon, while visually attractive, is not ready to be immediately sold.

SUMMARY OF THE INVENTION

It is therefore an object of the present invention to provide an overhead display unit for a plurality of inflated balloons, each said balloon having a characteristic pillow shape with a generally planar front and back surface decorated with indicia, such display unit having a peripheral structure to position and display a decorative indicia for viewing by prospective purchasers.

Another object is to provide such a display unit which requires a minimal amount of support from the ceiling system from which it is suspended.

These and other objects of the invention are achieved by a device for displaying a plurality of inflated balloons. Each balloon has a characteristic thickness, height and width. The characteristic thickness is less than either the characteristic width or height, and is essentially normal to a generally planar decorated surface of the balloon. The device comprises a perimeter formed from at least one length of a downwardly-open channel member. The downwardly-open channel member has a width slightly larger than the characteristic thickness of the inflated balloons so as to prevent rotation inside the channel of any such balloon about an axis other than that corresponding to the characteristic thickness.

In one embodiment of the invention, the perimeter and a ceiling to which the perimeter is affixed form a downwardly-open cavity to hold additional inflated balloons. In a preferred form of this embodiment, the perimeter is formed by a grid of wires.

In another embodiment, the perimeter formed from the at least one length of downwardly-open channel member is affixed along its top edges to a top retaining member such that the top retaining member and the perimeter form a downwardly-open cavity to hold additional inflated balloons. In a preferred form of this embodiment, the channel member and the top retaining member are each formed by a grid of wires. In the preferred embodiment, the perimeter is rectangular.

In the preferred embodiment, the device comprises a central unit and two end units. The central unit is comprised of at least one central unit member. Each central unit member has a generally rectangular grid of wires constituting the upper retaining member. A first pair of opposing sides ofthe central unit member have a length of the downwardly-open channel member pending downwardly therefrom. Each end unit comprises a further length portion of said downwardly-open channel member, so that one of the end units is attached to and pends downwardly from the one of the remaining pair of opposing sides of the central unit member. Additional central unit members may be attached along one of the remaining pair of opposing sides on each to form an extended central unit.

BRIEF DESCRIPTION OF THE DRAWINGS

Better understanding of the present invention will be obtained when reference is made to the appended drawings, which are made a part hereof, wherein identical parts are identified by identical reference numerals, and wherein.

DETAILED DESCRIPTION OF THE DRAWINGS

Figure 1:
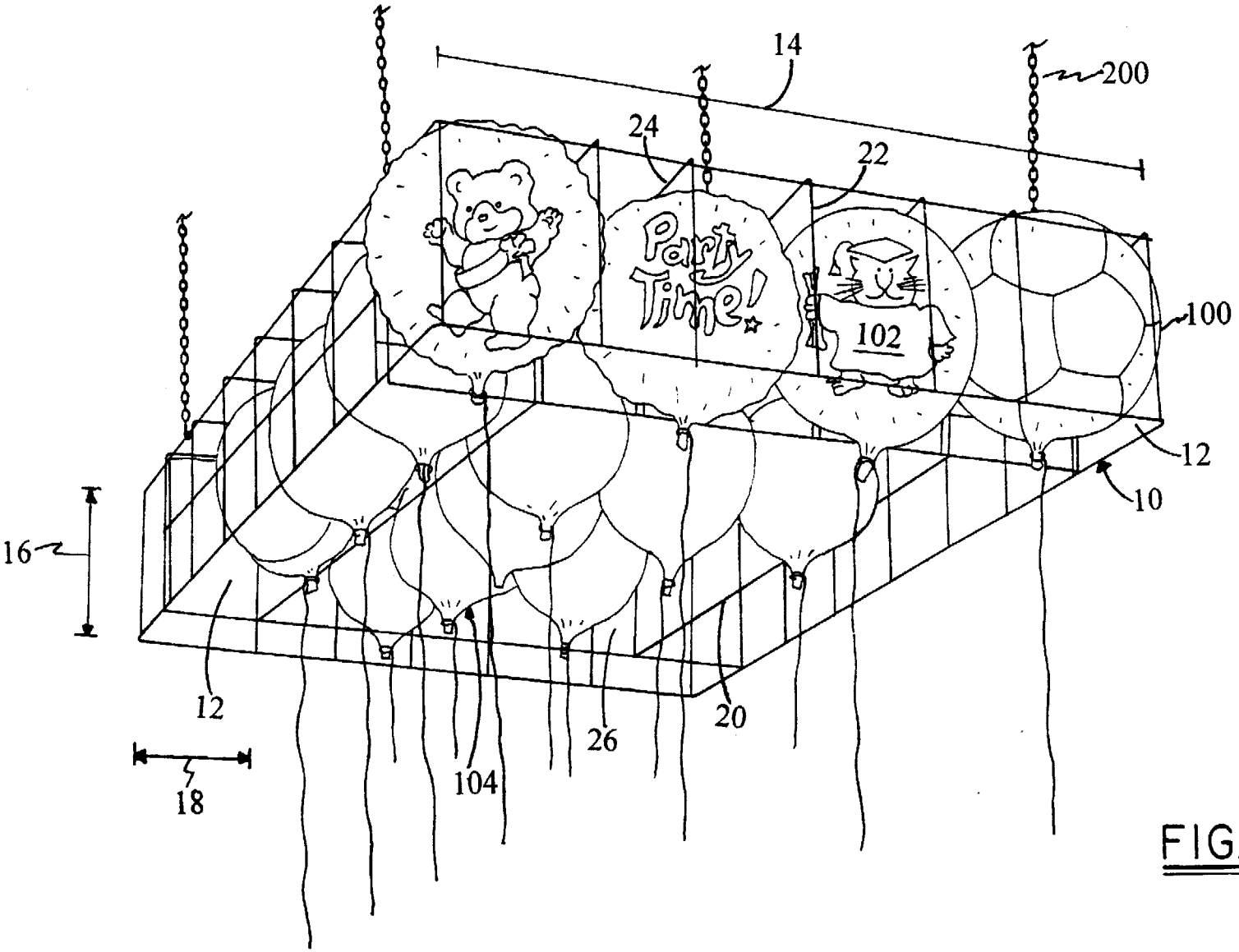
FIG. 1 shows a perspective view of the preferred embodiment of the balloon display unit of the present invention as installed and containing balloons.

A typical MYLAR-type balloon 100, as known in the prior art, is shown in FIG. 1, in which it is displayed in the preferred embodiment of the display device of the present invention. Such a MYLAR-type balloon 100 is typically formed from a pair of identical sheets of MYLAR, a thin polyester material produced by E.I. du Pont de Nemours & Company of Wilmington, Del. The sheets are sealed by thermal or adhesive means around the periphery. Typically a MYLAR-type balloon 100 formed from two circular MYLAR sheets each having a diameter of about 18 inches will, upon inflation with a suitable amount of inflation gas, such as helium, form a pillow-shape solid having a diameter of approximately 12 inches to 15 inches and a thickness at the center portion of approximately 8 inches to 8½ inches. This thickness dimension T is essentially normal to the surface of the two sheets which comprise the generally planar front and rear surfaces of the balloon 100. At least one of these generally planar surfaces 102 is decoratively adorned with indicia, words and the like. Orthogonal to the thickness dimension T are width and height dimensions, W and H, respectively, both of which will be larger than the thickness dimension T. While the circular format is the most common used in this sort of balloon, other shapes may be similarly sealed and formed into balloons, in which a characteristic thickness at the central portion of the balloon can be considerably thicker or thinner than the 8 inches to 8½ inches of a balloon formed from 18 inch diameter MYLAR circles. However, in all cases, the thickness dimension T will be smaller than the width W or height H.

In its most preferred embodiment, the present invention is an overhead display unit 10 intended for display of a plurality of the balloons 100. In a first form, the overhead display unit 10 comprises a simple perimeter formed of one or more lengths of downwardly open channel 12. When embodied as a linear member, as in the preferred embodiment, each length of downwardly open channel 12 has a length dimension 14, a height dimension 16 and a thickness dimension 18. Being downwardly open, each length of downwardly open channel 12 is formed from an inside retaining member 20, an outside retaining member 22 and a top retaining member 24. The purposes of each retaining member 20, 22 or 24 are to retain the inflated balloons 100 displayed therein, while effectively allowing them to be viewed with their decorated generally planar surface 102 essentially facing directly outwardly to the outside retaining member 22. For that reason, the preferred manner of manufacturing the retaining members 20, 22 or 24 is to form a generally planar grid of intersecting wires, typically steel wires of 7 to 9 gauge diameter. The center-to-center placements of the wires must be small enough to retain the balloons 100, but this will not generally require the wires to be any closer than about 8 inches to accomplish this purpose, and even larger spacings will often be permissible while still maintaining the retaining nature of the retaining member 20, 22, or 24. Placing the wires too close will tend to obstruct the view of the balloons 100. The wires are joined at their intersections by conventional means, such as welding, soldering, brazing and the like. To minimize the visibility of the wires and to endue them with aesthetic appeal, it is preferred to coat the wires by powder technology and the like. In the preferred embodiment of the present invention, the individual lengths of downwardly-open channel 12 will be straight, so that the inside retaining member 20, the outside retaining member 22 and the top retaining member 24 will each be rectangular in shape. The preferred dimensions of such a length of downwardly-open channel 12 will be set by the size of the balloons 100 to be displayed therein. As an example, when the balloons 100 to be displayed are made from 18 inch MYLAR circles, as described above, the inside and outside retaining members 20, 22 will typically be at least about 12 inches high, so that the majority of the height dimension of the balloon 100 fits inside the channel. The length of the side retaining members 20, 22 is a matter of design choice, but will typically be long enough to allow side-by-side display of at least three balloons 100. The top retaining member 24 will have the same length dimension as the side members 20, 22, and the width of the top retaining member, which determines how far apart the inside and outside retaining members will be, will typically be about 10 to 25 percent larger than the thickness dimension T of the displayed therein. For a balloon 100 with an 8 to 8-½ inch thickness, the width of the top retaining member 24 should be around 9 inches. Four lengths of the downwardly-open channel 12 so described may be joined together to produce a rectangular perimeter, with outside retaining members 22 providing the necessary display capacity to exhibit the plurality of balloons 100. Although FIG. 1 shows the display unit 10 pending from a ceiling by chains 200, if the top retaining members 24 of such a rectangular assembly are affixed directly to the ceiling, the downwardly-open interior cavity 26 formed by the inside retaining members 20 and the ceiling, which acts as an upper retaining member, constitutes a storage area capable of holding additional inflated balloons 104, which are readily accessible for sale, the balloons 100 displayed in the downwardly-open channel 12 providing examples of the various types of balloon 104 available in the storage area.

Returning to FIG. 1, many display environments have a ceiling which is sufficiently high that the display unit 10 will need to be suspended from the ceiling, rather than directly affixed thereto. In that case, it will not be possible to use the ceiling as the upper retaining member to form the downwardly-open interior cavity 26. Instead, an upper retaining member 28 will be affixed to at least the top edges of the perimeter lengths of downwardly-open channel 12, thereby establishing the downwardly-open interior cavity 26. Although the upper retaining member is not clearly visible in FIG. 1, it is more clearly seen in FIG. 2, where an especially preferred construction of the present invention is taught.

Figure 2:
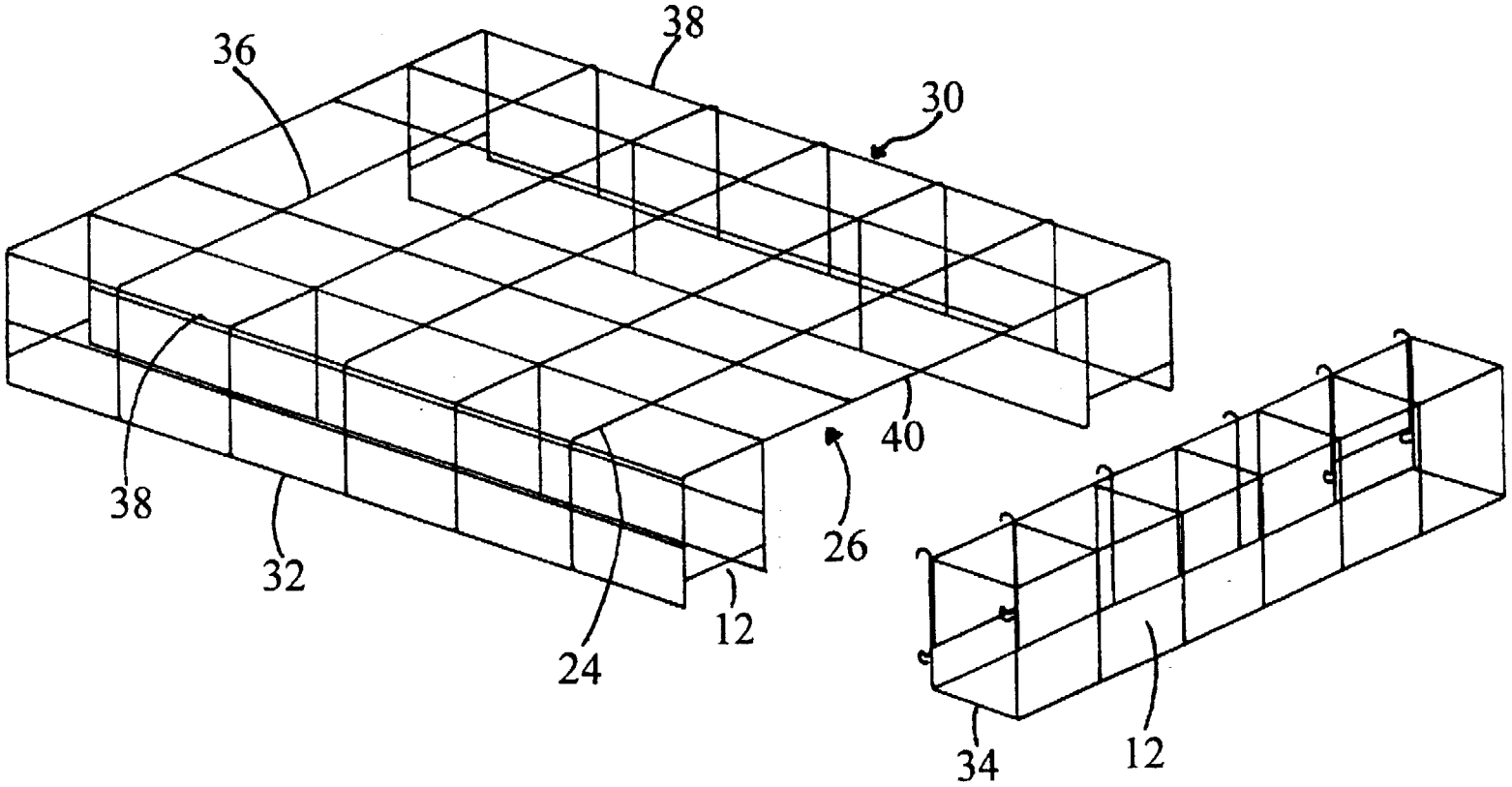
FIG. 2 shows a central unit and an end unit of the preferred embodiment in perspective view in an unassembled state.
Figure 3:
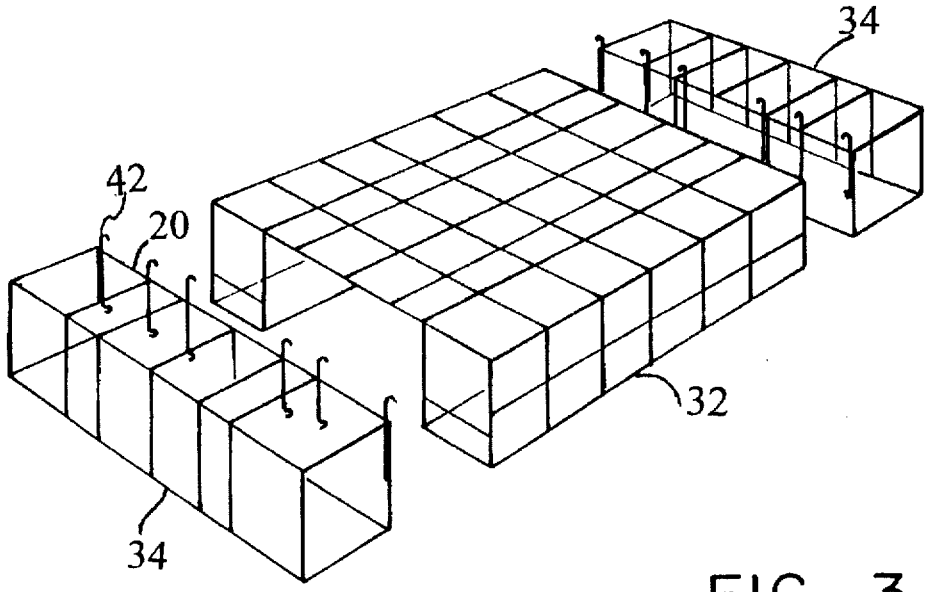
FIG. 3 shows a central unit and two end units of the preferred embodiment in perspective view in an unassembled state.

The especially preferred construction 30 of the balloon display device 10 of the present invention is shown in perspective view without balloons in FIGS. 2 and 3. The balloon display device 30 is formed from at least one central unit 32 and a pair of end units 34, one such end unit being shown in FIG. 2 and a pair of them being shown in FIG. 3. In such an embodiment, the central unit 32 will comprise a rectangular retaining member 36, preferably formed from a grid of wires as described above. Being rectangular, the retaining member 36 has four side edges, consisting of two pair of opposing side edges. When a first pair of such side edges 38 each have a length of the downwardly-open channel 12 described above attached thereto or integral therewith, then a portion of the retaining member 36 comprises the top retaining member 24 and the remainder of the retaining member 36 comprises the upper retaining member 28. An end unit 34 of such an especially preferred embodiment 30 will be attached to each of the remaining pair of opposing side edges 40, as shown in FIGS. 2 and 3. In this manner, the rectangular perimeter constituting the downwardly-open channel for displaying the balloons 100 is formed, as well as the downwardly-open interior cavity 26 for storing additional balloons 102.

Figure 4:
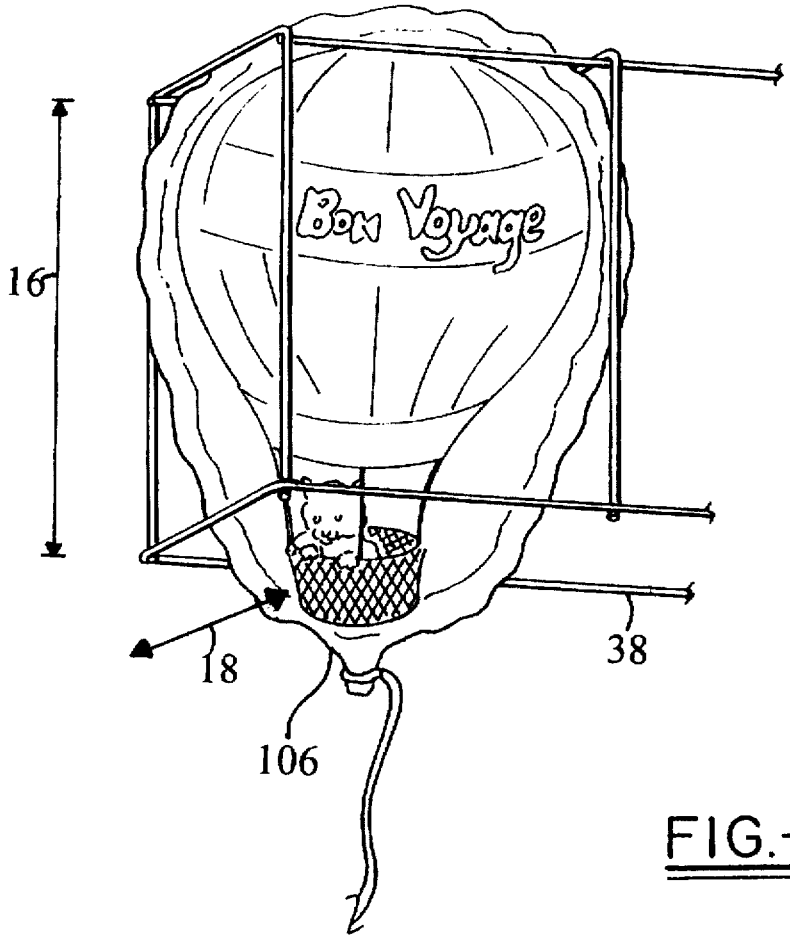
FIG. 4 shows a further embodiment of the end unit of the preferred embodiment in perspective view and holding a larger balloon.

As shown in FIG. 4, one or more of the end units attached to one or more central units 32 may be a larger end unit 38. In such an end unit 38, the height 16 and the thickness 18 of the downwardly-open channel are larger than in the standard end unit 34, so that these larger end units 38 may be used to display larger balloons 106.

Figure 5A:
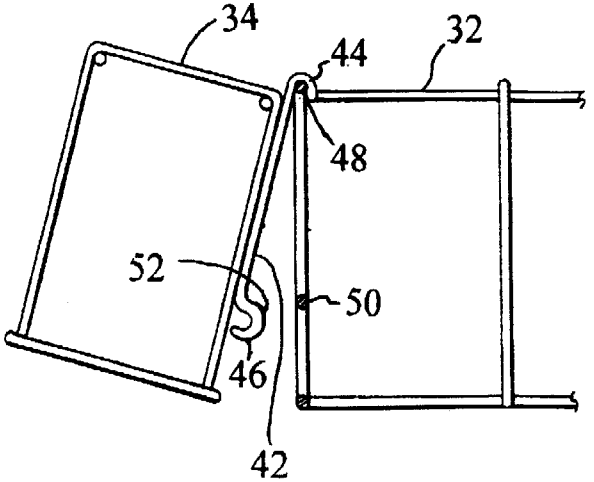
FIG. 5A and 5B show in side plan view the preferred assembly of an end unit to a central unit of the preferred embodiment.
Figure 5B:
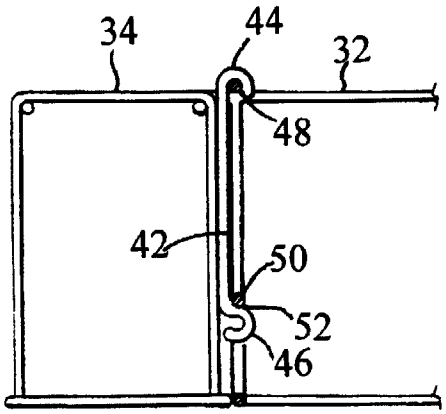

The detail of how to connect a central unit 32 and an end unit 34 are shown in FIGS. 5A and 5B. In FIGS. 2 and 3, a plurality of the attaching units 42 are shown affixed to the inside retaining member 20 on the end unit 34. As shown in detail in FIGS. 5A and 5B, each attaching unit 42 has a first end 44 and a second end 46. First end 44, which is shaped into a finger-like projection, is adapted to fit over a wire 48 on the top retaining member of the central unit 32. Second end 46, which is shaped somewhat like a shepherd's crook, is positioned so that when the first end 44 engages the central unit wire 48, a second wire 50 on the central unit 34 nestles into a hollow 52 at the base of the crook, resulting in a friction fit,as shown in FIG. 5B.

Figure 6:
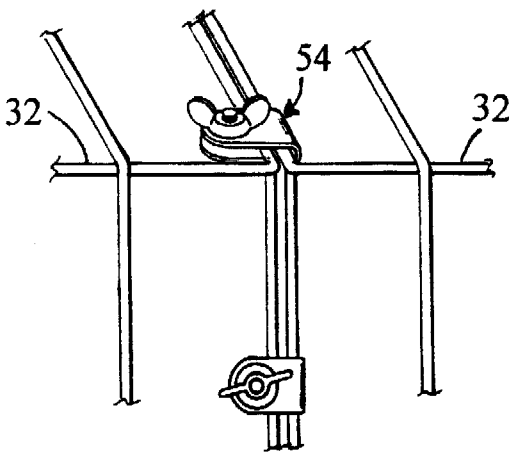
FIG. 6 shows in exploded view a device for attaching central units of the preferred embodiment.
Figure 7:
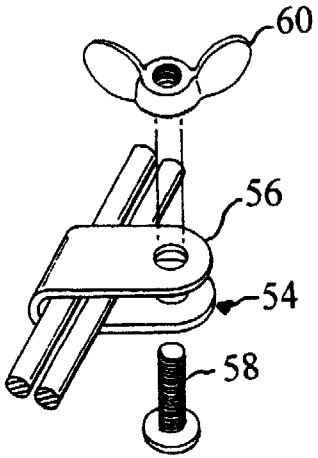
FIG. 7 shows in perspective view attached central units of the present invention.

Turning now to FIGS. 6 and 7, it also becomes clear that if two central units 32 are affixed to each other along one of the remaining pair of opposing side edges 40 on each central unit 32 and an end unit 34 is then affixed to the other side edge 40 on each central unit, then a display unit having an extended length is formed. Details of how to connect two such central units 32 are shown in FIGS. 6 and 7. In FIG. 7, an exploded view is shown of the grid joiner 54, which comprises a U-clamp 56, formed typically from 18 gauge steel, a screw 58 and a wing nut 60. Care should be exercised to always place the wing nut 60 on the outside of the connection, to avoid it coming in contact with the balloons. FIG. 6 shows these components in typical engagement for securing one central unit 32 to another.

While the specific examples shown in the drawings relate to rectangular perimeter embodiments, the concept of the present invention may be extended from perimeters having as few as three sides, to a circular embodiment having, in theory, an infinite number of sides. In each case, the downwardly-open interior cavity 26 will be available to hold available balloons 104 while the perimeter downwardly-open channel 12 holds display balloons 100 in a non-rotating position so that the decorative face is visible through the outside retaining member 20.

While the best mode and preferred embodiment have been described in order to comply with patent laws, the scope of the present is not to be measured by the foregoing specification, but is instead to be determined by the scope of the claims which are appended hereto and made a part hereof.

What is claimed is:

1. A device for displaying a plurality of lighter-than-air inflated balloons, each of said inflated balloons having a characteristic thickness, height and width, the characteristic thickness being less than either the characteristic width or height, and being essentially normal to a generally planar decorated surface of the balloon, said device comprising:

a rectangular perimeter formed from at least four lengths of a downwardly-open channel member such that the at least four lengths of downwardly open channel member provide a downwardly-open perimetric cavity for the display of inflated balloons, said perimetric cavity having a width slightly larger than the characteristic thickness of the inflated balloons so as to prevent rotation inside the perimetric cavity of any such balloon about an axis other than that corresponding to the characteristic thickness with the perimeter formed from said at least four lengths of downwardly-open channel member being affixed along its top edges to a top retaining member such that the top retaining member and the perimeter form a downwardly-open interior cavity to hold additional inflated balloons;

the perimeter being formed from a central unit and two end units, the central unit comprising at least one central unit member, each central unit member having a generally rectangular grid of wires constituting the top retaining member, with a first pair of opposing sides thereof each having a length of said downwardly-open channel member pending downwardly therefrom, and each end unit comprising a further length portion of said downwardly-open channel member, wherein one of the end units is attached to and pends downwardly from one of the remaining pair of opposing sides of the central unit member;

wherein the end units are attached to the central unit through a plurality of attaching units, each said attaching unit comprising a length of wire having a first end shaped into a finger-like projection and which fits over a wire on the top retaining member of the central unit and a second end which is shaped like a shepherd's crook and which is positioned so that when the first end is fitted over the wire, the second end engages a second wire on the central unit such that the second wire nestles into a hollow at the base of the crook, resulting in a friction fit.

2. The device of claim 1 wherein the central unit comprises at least two central unit members, wherein adjacent central unit members are attached to each other by a plurality of clips, each said clip comprising a U-clamp, a wing nut and a screw, where the U-clamp surrounds a wire from each central unit member and the wing nut and screw close the U-clamp to hold the wires in proximity.

3. A device for displaying a plurality of lighter-than-air inflated balloons, each of said inflated balloons having a characteristic thickness, height and width, the characteristic thickness being less than either the characteristic width or height, and being essentially normal to a generally planar decorated surface of the balloon, said device comprising:

a rectangular perimeter formed from at least six lengths of a downwardly-open channel member such that the at least six lengths of downwardly open channel member provides a downwardly-open perimetric cavity for the display of inflated balloons, said perimetric cavity having a width slightly larger than the characteristic thickness of the inflated balloons so as to prevent rotation inside the perimetric cavity of any such balloon about an axis other than that corresponding to the characteristic thickness with the perimeter formed from said at least six lengths of downwardly-open channel member being affixed along its top edges to a top retaining member such that the top retaining member and the perimeter form a downwardly-open interior cavity to hold additional inflated balloons;

the perimeter being formed from a central unit and two end units, the central unit comprising at least two central unit members, each central unit member having a generally rectangular grid of wires constituting the top retaining member, with a first pair of opposing sides thereof each having a length of said downwardly-open channel member pending downwardly therefrom, and each end unit comprising a further length portion of said downwardly-open channel member, wherein one of the end units is attached to and pends downwardly from one of the remaining pair of opposing sides of the central unit member and with one of the remaining pair of opposing sides of one of the central unit members affixed to one of the remaining pair of opposing sides of another of the central unit members so that the end units are attached to opposing sides of the central unit members comprising the ends of the central unit;

wherein the adjacent central unit members are attached to each other by a plurality of clips, each said clip comprising a U-clamp, a wing nut and a screw, where the U-clamp surrounds a wire from each central unit member and the wing nut and screw close the U-clamp to hold the wires in proximity.

* * * * *